United States Patent [19]

Capasso

[11] 4,380,762

[45] Apr. 19, 1983

[54] POLYFUNCTION PROGRAMMABLE DATA RECEIVER

[76] Inventor: Gaetano Capasso, Ottaviano, Napu, Italy

[21] Appl. No.: 236,367

[22] Filed: Feb. 20, 1981

Related U.S. Application Data

[63] Continuation of Ser. No. 117,317, Jan. 31, 1980, abandoned.

[51] Int. Cl.[3] ..... G08C 19/22

[52] U.S. Cl. ..... 340/825.63; 340/825.69; 340/825.3

[58] Field of Search ..... 340/825, 825.3, 825.57, 340/825.62, 825.63, 825.65, 825.69

[56] References Cited

U.S. PATENT DOCUMENTS 3,858,116 12/1974 Friedl et al. ..... 340/825.63

4,245,347 1/1981 Hutton et al. ..... 340/825.63

4,305,060 12/1981 Apple et al. ..... 340/825.69

*Primary Examiner*—Alvin H. Waring

*Attorney, Agent, or Firm*—N. Rhys Merrett; Melvin Sharp; Gary Honeycutt

[57] ABSTRACT

A polyfunction programmable data receiver comprising means for receiving a string of serial data followed by a control signal; means for detecting said signal comprising a pulse length analyzer, and a counter and a comparator; bidirectional means for setting up a digital word to be identified or for providing in parallel the data of said string according to the status of a mode selection circuit; means for providing an output signal if the comparison between said serial string and said set up digital word is favorable when the receiver operates as identifier, or an enabling signal when the receiver operates as a series/parallel converter. Some applications of this circuit are also disclosed.

9 Claims, 13 Drawing Figures

PWD, INTERNAL TIMING

[* = DEVICE ACCORDING TO THE INVENTION]

SINGLE-WIRE INTERCOM CONTROL

POWER SUPPLY AVAILABLE

POWER SUPPLY OBTAINED FROM A.C.

EXTERNAL COMPONENTS FOR INTERCOMS

[* = DEVICE ACCORDING TO THE INVENTION]

REMOTE CONTROL
FOR 8-CHANNELS SINGLE RECEIVER

REMOTE CONTROL FOR 8-CHANNELS ADDRESSABLE RECEIVERS

SINGLE-LINE SYSTEM FOR TRAFFIC CONTROL (* =DEVICE ACCORDING TO THE INVENTION)

CODED ADDRESSABILITY OUTPUT EXPANDER FOR MICROPROCESSOR

POLYFUNCTION PROGRAMMABLE DATA RECEIVER

This is a continuation, of application Ser. No. 117,317, filed Jan. 31, 1980 and now abandoned.

The present invention relates to an asynchronous, programmable digital data receiver able to perform a plurality of functions, conceived for dialoging with a microprocessor.

More particularly, the present invention relates to a data receiver able to identify a predetermined code by means of a wired set-up on the outputs of a bidirectional bus which, according to the preselected operation mode may also operate as a series/parallel data converter.

The circuit of the data receiver according to the present invention is particularly suitable for the realization as an integrated monolithic circuit. In the following disclosure, in addition to the description of its structure and operation, some particularly significant applications will be illustrated by way of example.

Embodiments of the present invention together with possible applications will be now disclosed by way of example, with reference to the drawings, wherein.

Figure 1:
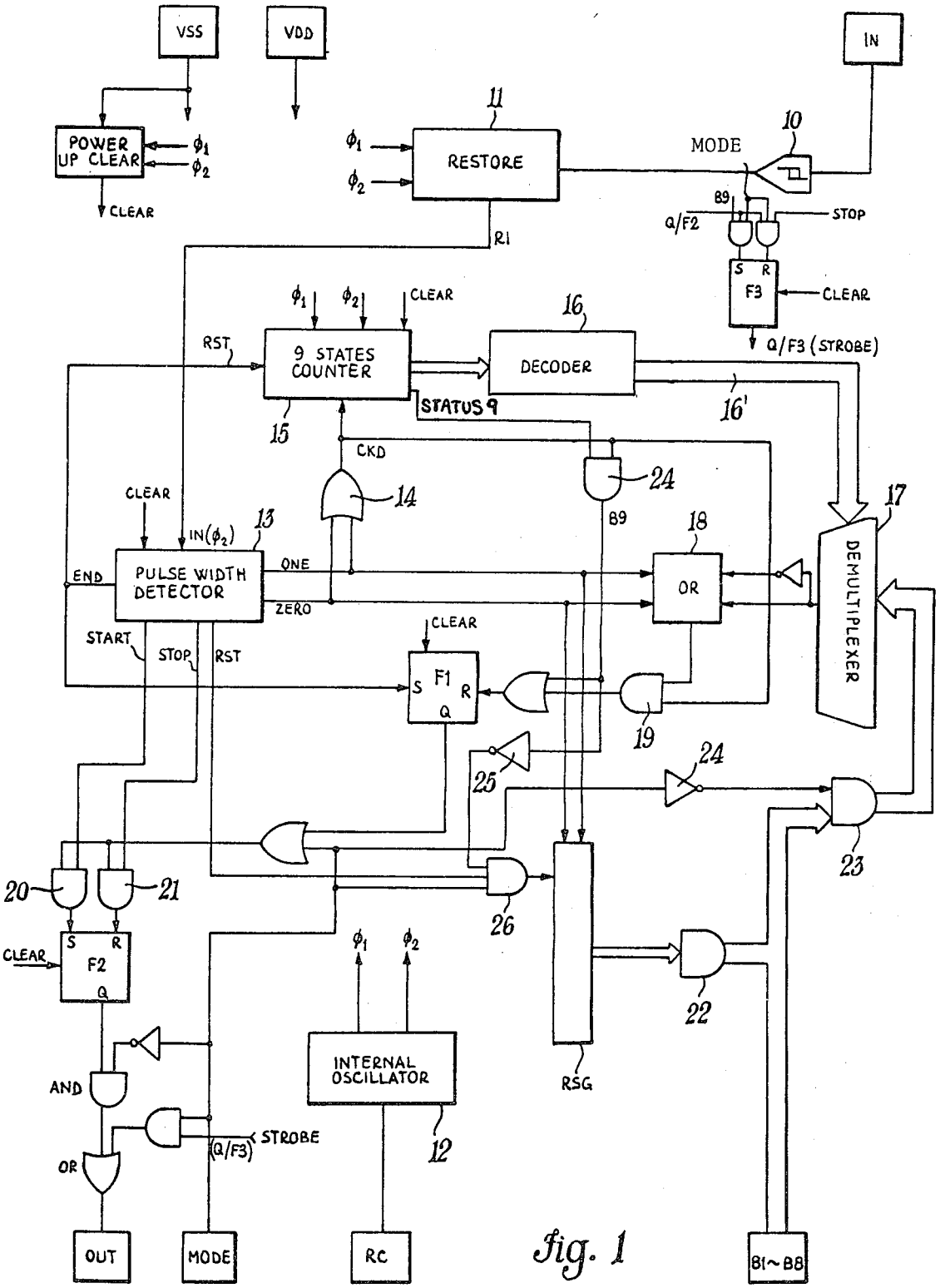
FIG. 1 shows the block diagram of a data receiver embodying the invention.
Figure 2:
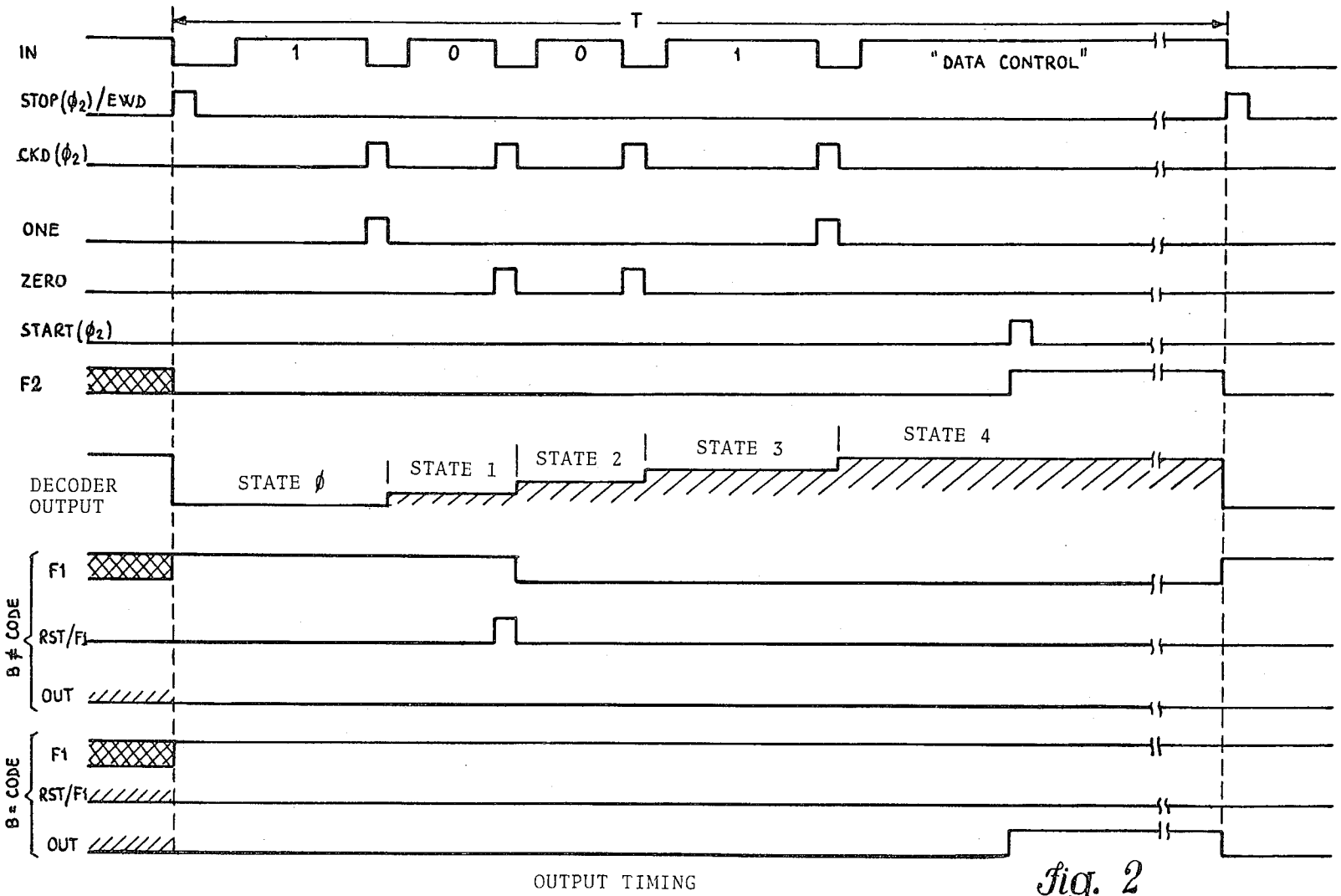
FIG. 2 shows waveforms relating to the operation of the circuit of FIG. 1 in a first operating mode.

Let us refer to FIG. 1 which shows the general block diagram of a circuit embodying the present invention in conjunction with FIG. 2.

An input signal indicated IN in FIG. 2 comprises a sequence of "1" and "0", for inst. a string comprising at maximum 8 bits followed by a signal indicated as "DATA CONTROL" and is applied to the terminal IN of FIG. 1. As one can see from FIG. 2, the signal starts from a logic level (0) and contains a sequence of high logic signals spaced by low logic signals, in which the length of the high signals is a function of the information which is required to be identified by the circuit.

There are foreseen 4 different lengths according to the code information "0", "1", "set" and "reset". These signals are in an order of increasing length. The signal indicated with IN in FIG. 2 identifies as example a signal comprising 4 bits of actual information.

The input signal applied, as we have seen, to the terminal IN of the circuit of FIG. 1 is squared in the Schmitt circuit 10, the output of which is connected to a restore circuit 11, which performs in a known way the synchronization of the asynchronous input signal with the phase $\phi 2$ of an internal clock produced by an internal oscillator 12 controlled by an external RC group, not shown, connected to the terminals $\overline{RC}$. There are available on the outputs of the internal oscillator the non-overlapping phases $\phi 1$, $\phi 2$ shifted from each other by 180° and active on the low level. The oscillating frequency of the internal oscillator 12 must be much higher than the bit rate of the input signal in order to allow a good discrimination of the information contained in the input signal itself.

The output R1 of the restore circuit 11 is connected to the input of a pulse width detector (PWD) for detecting circuit 13 the length of the input pulses to the circuit. The operation of the PWD circuit 13 will be disclosed in detail in the following:

It is assumed that previously the signal R1 has been at a high level (prior to the interval T shown in FIG. 2) with the consequent emission of a signal END when R1 goes to the low level. With the IN signal represented in FIG. 2, the circuit 13 (PWD) will produce output signals STOP, ONE, ZERO, START and END, as is shown in the waveform of FIG. 2. A signal CKD is produced by the OR 14 between the signals ONE, ZERO from the circuit 13. The END signal, previously produced had set the flip-flop F1, and cleared the 9 stage counter 15.

It is assumed that the MODE terminal is at a low logic level and therefore that the device operates as a signal comparator of the input signal IN with a digital word set-up or programmed on the terminals B1~B8. The signal CKD advances the counter 15, the coded outputs of which, decoded by the decoder 16, select on a data bus 16' one of the inputs of a demultiplexer 17 which produces an output which is brought to one of the inputs of the EXCLUSIVE-OR gate 18. To the other input of the EXCLUSIVE-OR gate 18 there are applied the signals ONE, ZERO coming from the PWD 13 and corresponding to the input signal. The output of the EXCLUSIVE-OR gate 18 is AND-ed in the AND gate 19 with the signal CKD, and the output of the AND 19 constitutes the reset signal for the flip-flop F1.

The purpose of the circuit constituted by the units 15, 16, 17, 18, 19 and F1 is the one of comparing bit by bit the arriving code at the termal IN with the reference code which had been set up on the inputs B1~B8 and therefore to reset the initially set flip-flop F1 if there appears a difference between the arriving code and the set up one. If the flip-flop F1 is not reset (Q at high level) it means that it has been ascertained the identity between the arriving code and the reference one. If such identity does not exist, the flip-flop F1 is reset and remains in such condition up to the arrival of the END signal contained in the input code.

In FIG. 2 there have been shown the wave forms relating to the cases of identity (B=CODE) and differnce (B≠CODE) between the input code and the one predisposed on the terminals B1~B8. It should be noted that, for convenience of representation, in FIG. 2 there has been shown an arriving code comprising only 4 bits (a pattern reduced with respect to the 8 possible bits).

The circuit limited itself to perform the recognition on the first 4 bits of the predisposed code because the transmitted code was followed by the signal "DATA CONTROL" previously mentioned and identifying the termination of the comparison operations. This occurs because with the identification of the "DATA CONTROL" by the PWD (13), continuation of the comparison operation is inhibited, permitting therefore a partial comparison with the programmed code. The PWD circuit (13), once it identifies the end of the sequence of the transmitted code, produces a START signal which puts the flip-flop F2 in a SET state if the output Q of the flip-flop F1 is high or if the result of the comparison had been favorable. At this moment, the output Q of the flip-flop F2 reaches the output terminal OUT, putting it at a logic level high. This confirms that the received code corresponds to the programmed code on the terminals B1~B8. The output on the terminal OUT, if high, will remain such for the whole duration of the signal "DATA CONTROL", or up to the generation by the circuit PWD (13) of a STOP signal which resets the flip-flop F2 if the output Q of the flip-flop F1 was high.

If the output Q of the flip-flop F1 was low (or the input code did not correspond with the preset one), the signals START and STOP would have been inhibited by the gates 20, 21 and therefore the flip-flop F2 would have been maintained in the preceding state.

From the above it appears clear that the output of the flip-flop F2 and therefore the output OUT will remain at a high logic level either up to the arrival of the STOP signal contained within the same signal "DATA CONTROL" or, if the signal "DATA CONTROL" has a length insufficient for the generation of the STOP signal, up to the receiving of the same code, but with the signal "DATA CONTROL" containing the STOP signal. Until such a signal arrives, the flip-flop F2 will remain in the high state, and the reception of other codes different from the one set up on the terminals B1~B8 will not change its state because the start and stop signals on F2 are inhibited through the gates 20, 21 constantly disabled by the low logic level of the output Q of the flip-flop F1, which is always such for all the recognition attempts with negative results.

Figure 3:
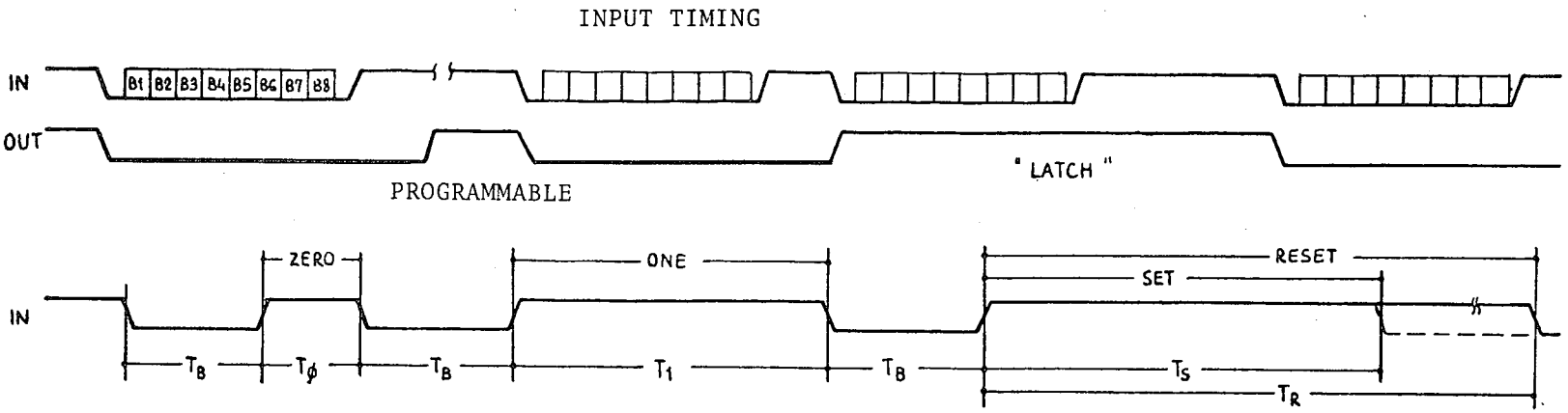
FIG. 3 shows waveforms relating to a second operation mode.

In this way, it is possible to change the duration of the high logic value on the output OUT of the selected device either putting it in relationship with the "DATA CONTROL" signal if the latter contains the STOP signal (direct command selection); or conditioning it to the interval included between the receiving of two signals containing the same code programmed on the terminals B1~B8, the first of which without the STOP in the "DATA CONTROL" and the second containing the STOP in the "DATA CONTROL" (LATCH operation) shown in FIG. 3.

Now, another operation mode of a device embodying to the invention will be described, wherein the MODE control is at high level logic, with a function as series/-parallel converter.

In this second mode the terminals B1~B8 behave as outputs of the device as a consequence of the operation performed by the gates 22, 23 and by the inverter 24'. At the arrival of the input signal (IN), the signals ONE, ZERO produced by the PWD circuit 13 reach the shift register RSG and are stored therein at the rate of the clock available on the terminal RST of the PWD circuit 13.

For differentiating the transmission of an address from that of data, there is introduced in the data a ninth bit (logic level 1) which, identified by the gate 24, through the inverter 25 inhibits the gate 26 and then the subsequent shift of the shift register RSG and, at the same time, setting the flip-flop F3 activates a STROBE signal (output Q of the flip-flop F3) available on the output OUT. Such a signal goes to a low level at the arrival of the STOP signal contained in the "DATA CONTROL" of the subsequent data to the one which has been transmitted and therefore as in the preceding mode has the function of adjusting the duration of the STROBE signal.

Figure 4:
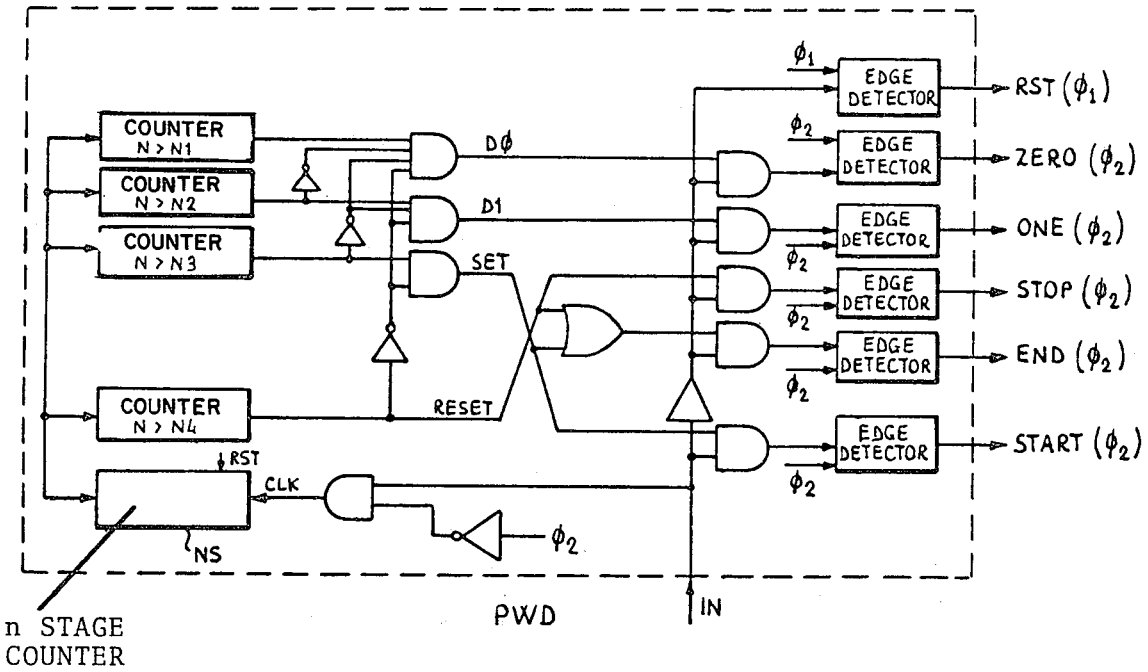
FIG. 4 shows a logic circuit diagram of the pulse width detector of FIG. 1.
Figure 5:
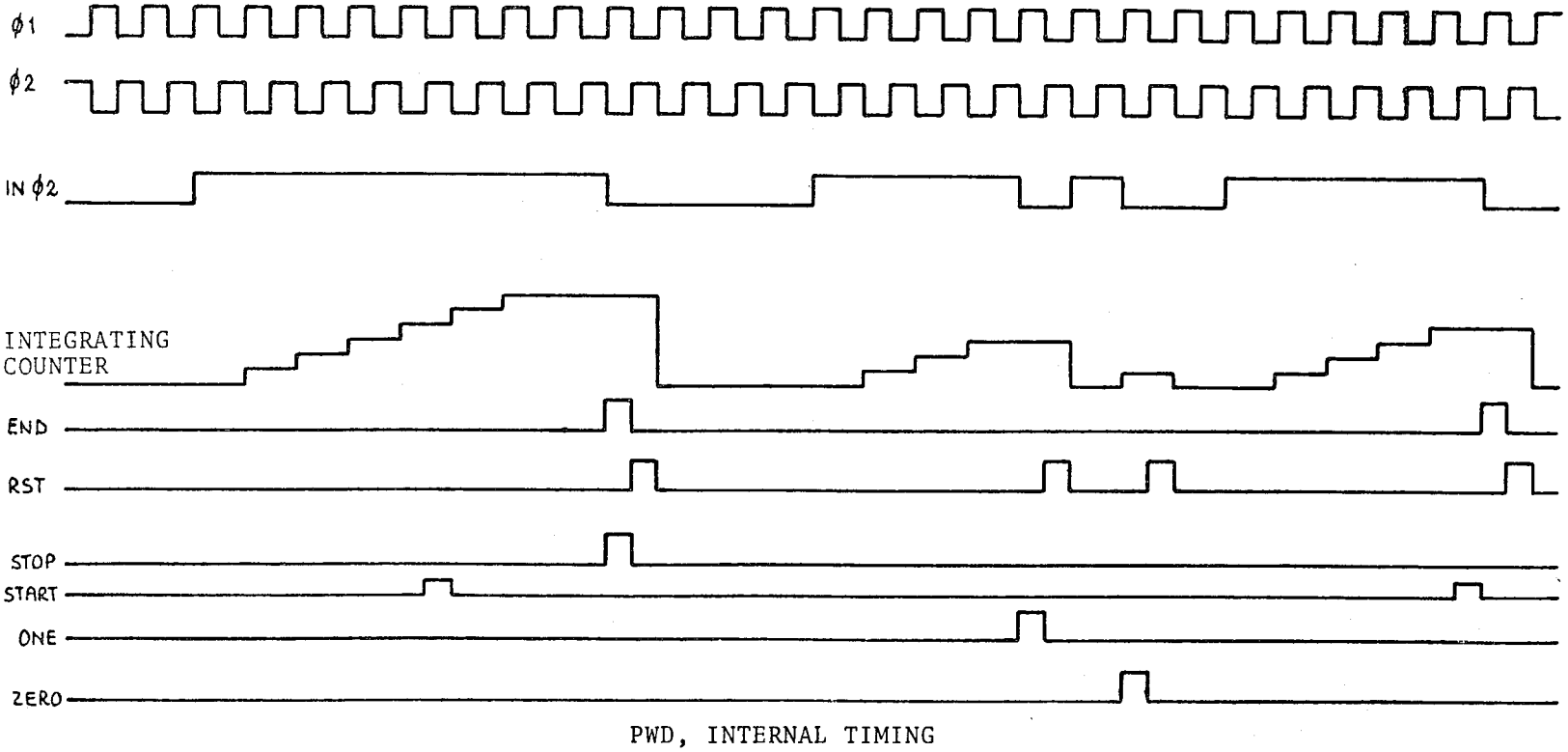
FIG. 5 shows waveforms illustrating the operation of the circuit of FIG. 4.

With reference to FIGS. 4 and 5, now the operation of the PWD circuit 13 will be disclosed. The circuit PWD is able to detect the duration of an input signal on terminal IN and to activate predetermined outputs when the duration of said signal is comprised between assigned values. In practice, the circuit discriminates four durations which in increasing order identify the signals Dϕ, D1, SET, RESET. The identification is obtained by means of the counting of a number of pulses having an assigned rate contained in the input signal, and is performed by the counters NS, and by four digital comparators which perform the comparison between the output of said counter NS and of the programmed codes, the whole in a known arrangement; the logic gates and the inverters which follow provide for the generation of the signals Dϕ, D1, SET, RESET. These signals are "AND-ed" with the input signal IN, and others with the signal $\overline{IN}$ and are applied to edge detectors for producing the signals RST, ZERO, ONE, STOP, START, END as it is shown in the timing wave forms shown in FIG. 5. The counter NS is reset by a low level on the input signal becoming then available for a second detection, etc.

Now, some applications of the device according to the present invention will be described.

A preeminent advantage of a device according to the invention lies in the realization of remote control systems with a single transmission line together with a circuit able to produce the control signals for its operation.

FIRST EXAMPLE

Figure 6:
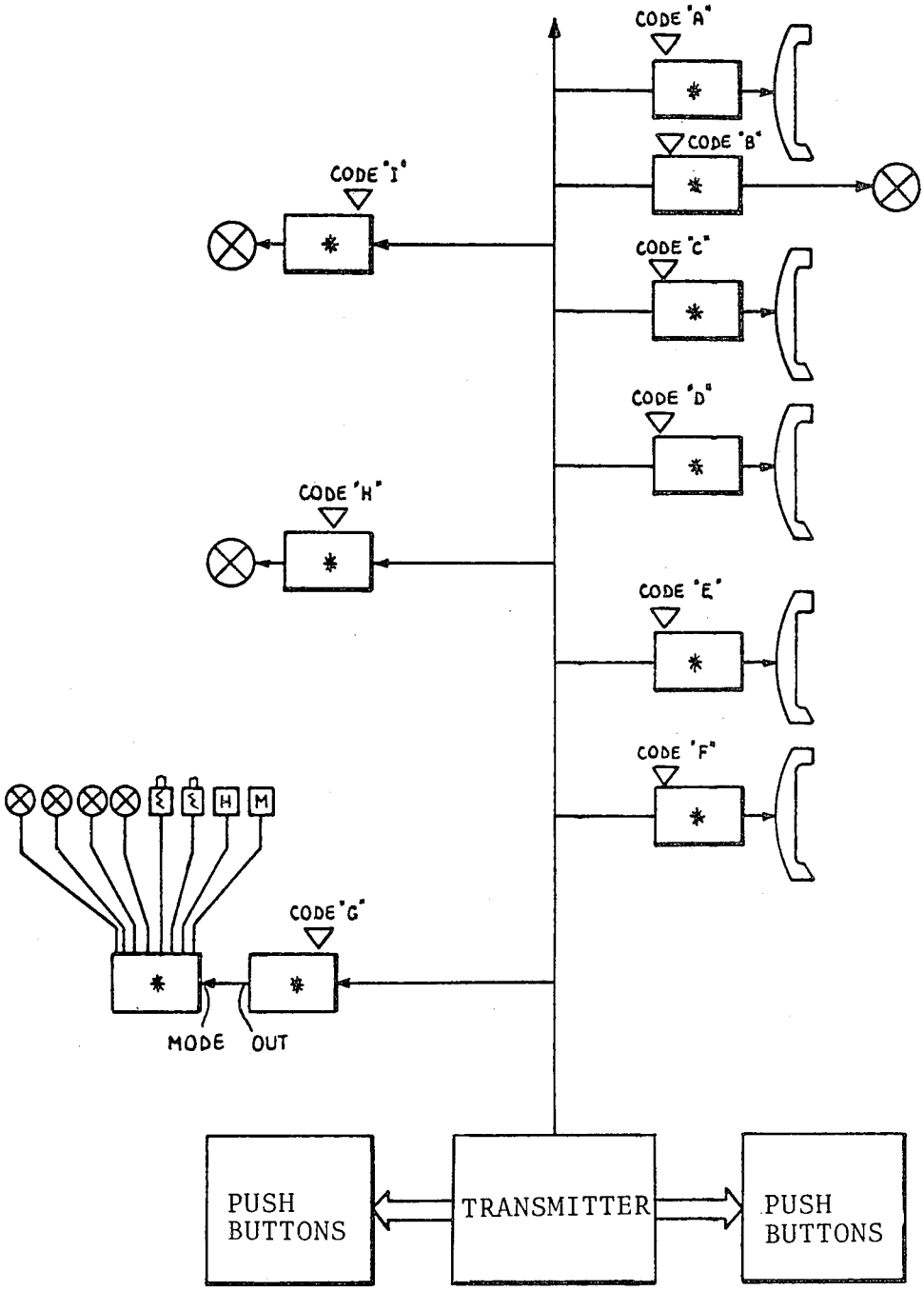
FIG. 6 shows an application of the device of FIG. 1 for the control of a single wire intercom system.

Single wire system for intercoms. In the first example (see FIG. 6) there is shown how with circuits as disclosed in FIG. 1, one for each intercom unit and two circuits for each group of eight users (lamps, locks, etc.) and a microprocessor it is possible to realize a classic intercom system, but with a single control line. The microprocessor (which is not disclosed into detail because it may be of known kind) when inputted identification of the utilizer which one wishes to call, sends on the single control line a serial code relating to the selected user, repeating it for a given time and at a given rate, in such a way that on the terminal OUT of the device in question (which will identify itself on the basis of the code) there will be present a square wave signal the mark to space ratio of which will be determined by the microprocessor. If such a signal is applied to an acoustic transducer, for inst. the same intercom receiver, one will hear an acoustic frequency on the selected intercom.

Figure 7:
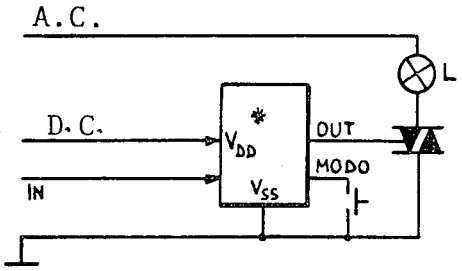
FIGS. 7 and 8 show a further application for the control of lights.
Figure 8:
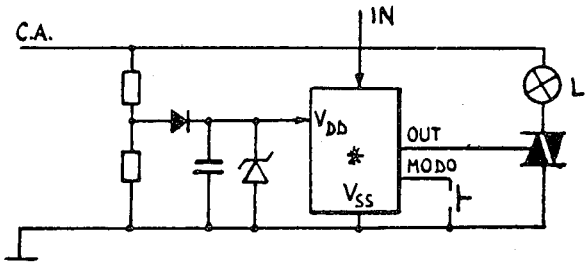

Similarly, if each lamp of a building is controlled according to the circuit as shown in FIGS. 7 and 8, it will be possible to control them by the microprocessor by sending the relevant codes on the same control line.

By arranging in cascade two circuits according to the invention, the first one operating as comparator and the second one operating as series/parallel converter, it is then possible to control groups of eight utilizers at the same time by sending the suitable codes always on the same line.

With the implementing of the technique now illustrated, made possible by the device embodying to the invention, the classic concept of intercom systems based on the sending of call signals on separate physical lines, a fact which renders extremely heavy the cost of the installation, maintenance, and overall cost of the system, is completely changed.

Advantages of the system now proposed may be summarized as follows:

(a) A lower installation cost of the system because it is no longer necessary to use multi-wire cable for interconnection, and the additional lines for the control of lights, stairs, locks and the like;

(b) Simplicity of installation. It is sufficient a single line for the address part which is common to all the connected intercoms;

(c) Simplicity of service. The drastic reduction of the number of conductors permits immediate identification and repair of possible failures;

(d) Immediate expansion of the system. It is sufficient to have a connection to an associate intercom to the common line and to connect it to the additional intercoms;

(e) Possibility of insertion of additional apparatus without connection. Since the address signals are sent on a single line, it is possible to add carrier wave communications realizing in this way extensions of the system without direct connection and therefore without appreciable installation expenses;

(f) Containment of the costs of the connected intercom. The additional costs caused by the presence of a device embodying the invention are compensated by the saving due to the absence of the ringer for incoming calls;

(g) Capability of performing additional services such as the control of lights, locks, motors, etc.

Other expansions of the possibility of use of a device embodying the invention will be clear to a person skilled in the art it being understood that the suggested ones are only as an example.

FIGS. 7 and 8 show the use of the device according to the invention for the remote control of lights. The understanding of the circuits is immediate and show in FIGS. 7 and 8, respectively, an embodiment with separate power supply and an embodiment with direct power supply. In these cases the output of the device according to the invention drives a TRIAC for the control of the lighting of a lamp L.

Figure 9:
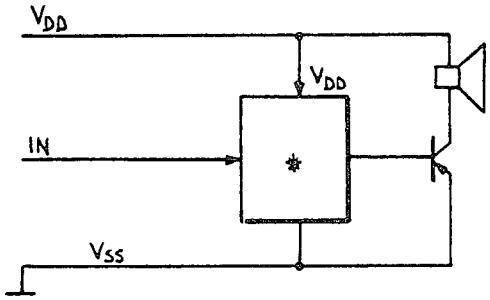
FIG. 9 shows an application as an acoustic signaling unit.

FIG. 9 shows the use of the device for an acoustical ringer, in which the output of the device drives a loudspeaker.

Figure 10:
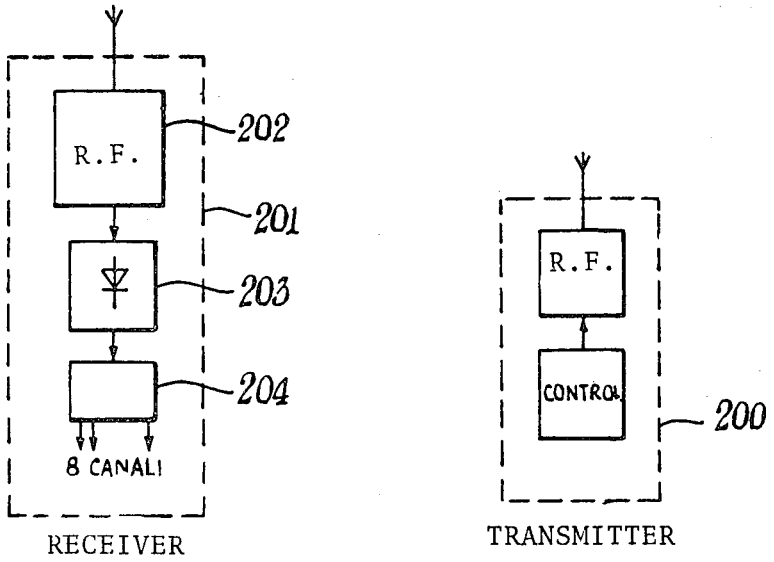
FIGS. 10 and 11 show applications of a receiver embodying the invention to radio controls.
Figure 11:
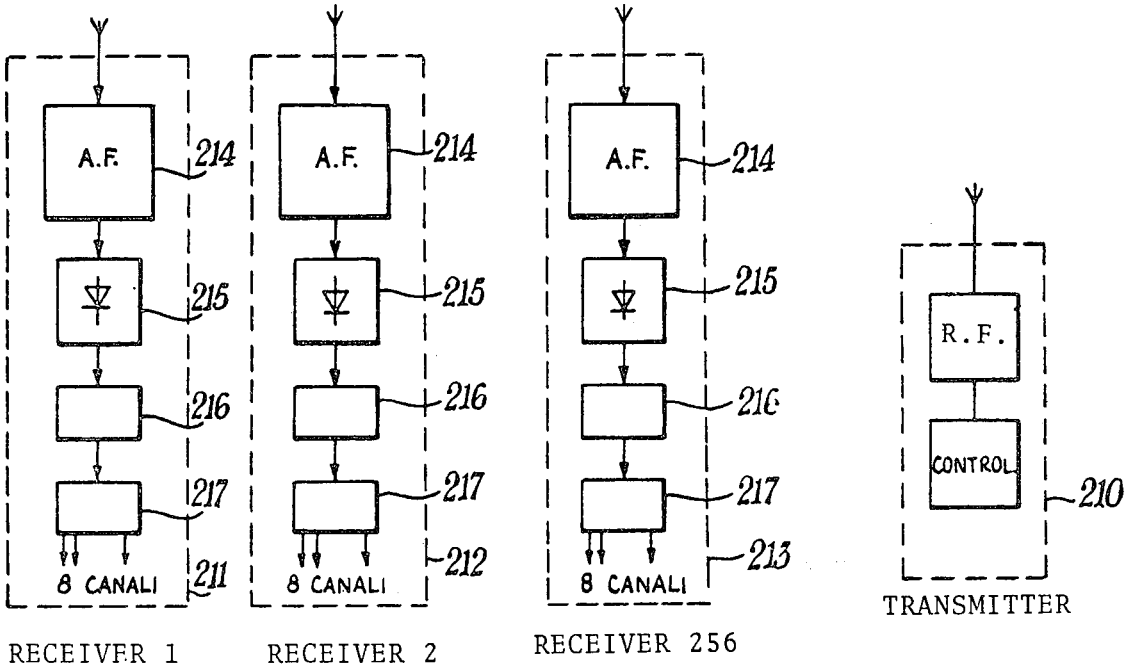

In FIGS. 10 and 11 an application of the device according to the invention is shown adapted for remote controls. For example, in FIG. 10 there is shown a remote control comprising a transmitter 200 and a receiver 201, having a radio frequency part 202, a detector 203 and a device 204 embodying the invention which permits control to be exercised on eight channels. In FIG. 11 there is shown a transmitter 210 and a plurality of receivers, up to 256, shown in 211, 212, 213, each of which comprises a radio frequency part 214, a detector 215, a first device 216 embodying the invention and a second device 217 embodying the invention connected in cascade. In this case one can have eight-channel remote controls each for a plurality of receivers which may amount to 256, i.e. $2^8$.

Figure 12:
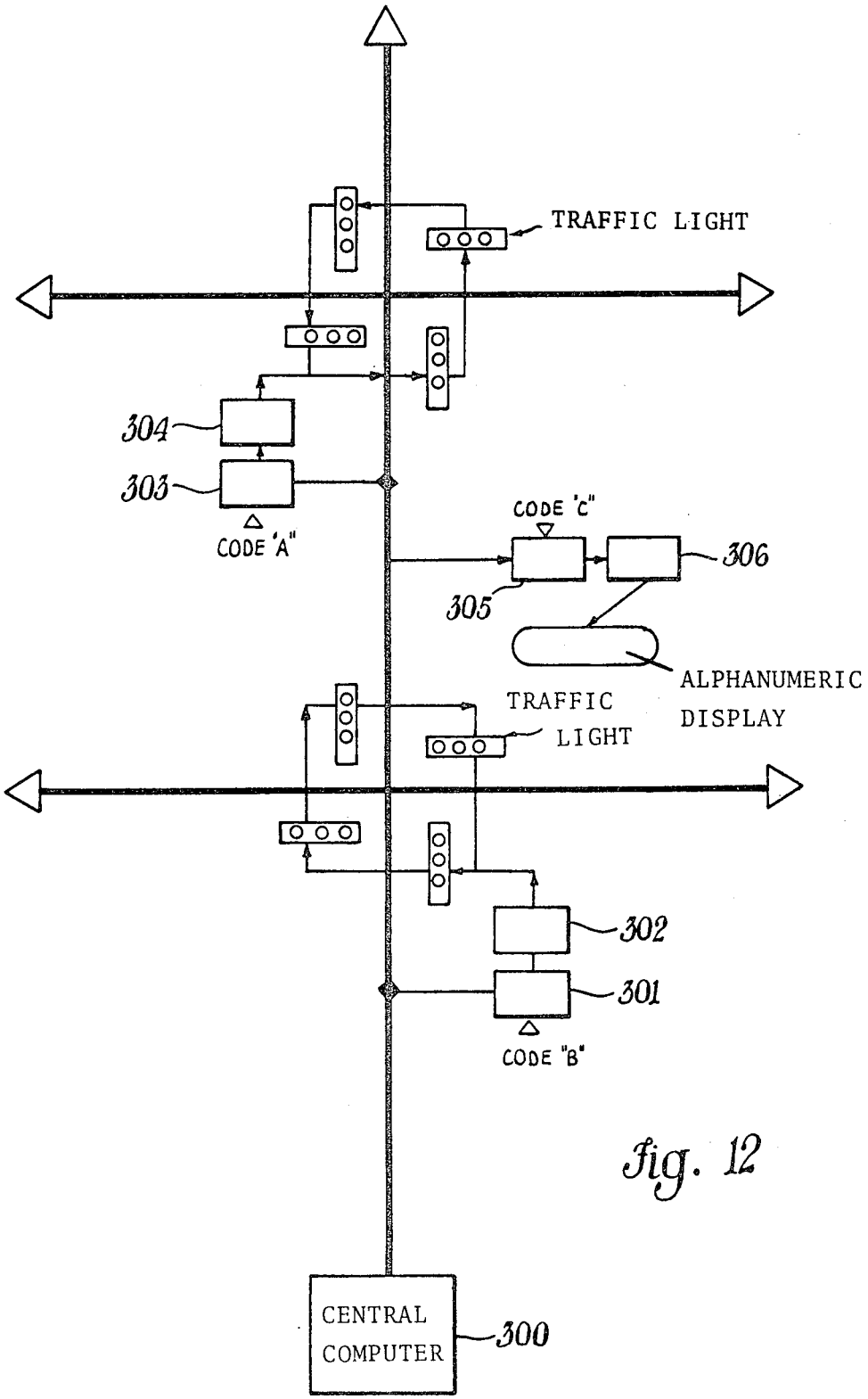
FIG. 12 shows an application of the receiver for the control of traffic lights.

In FIG. 12 there is shown an embodiment for the control of traffic lights by means of a main computer 300 and a plurality of devices embodying the invention operating in cascade of pars as shown in 301, 302; 303, 304; 305, 306. The operation is clear from the preceding description.

Figure 13:
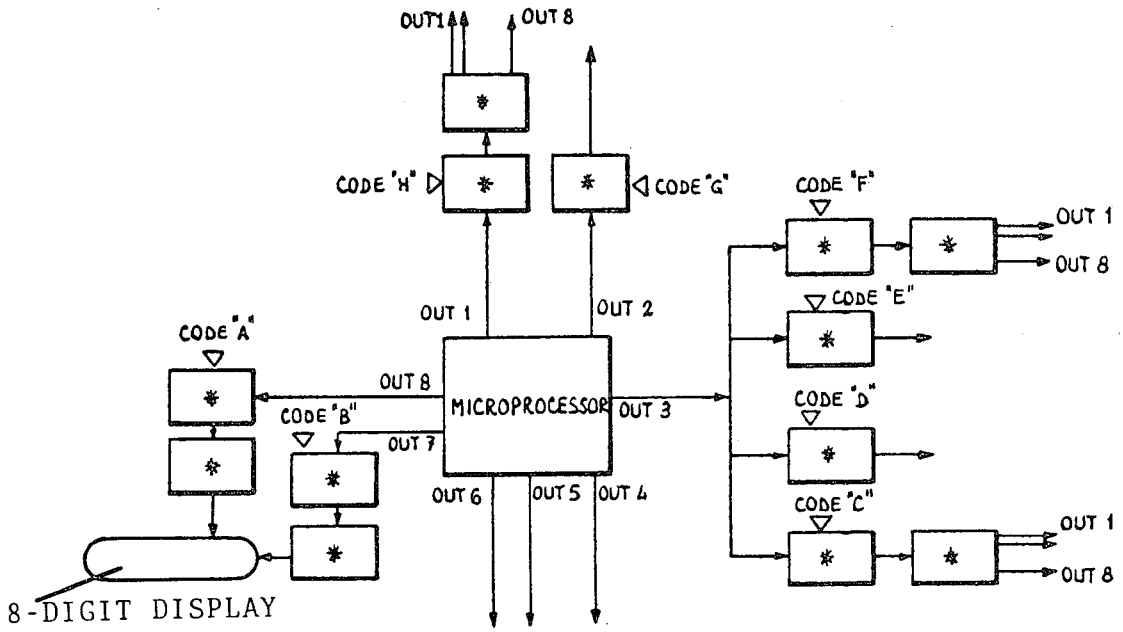
FIG. 13 shows the use of the receiver as an output expander for a microprocessor.

In FIG. 13 there is shown an output expander arrangement for a microprocessor with coded addressing. As it is clear to a person skilled in the art the basic outputs of the microprocessor send suitable codes to the several devices according to the invention in order to obtain an expansion of the outputs.

What is claimed is:

1. A programmable polyfunction data receiver comprising means for receiving a sequence of serial data signals followed by a control signal; pulse length analyzer means for detecting said signals; mode selection circuit means for controlling operation of said receiver in an input data validation mode or in a serial/parallel data conversion mode; bidirectional bus means for setting up a digital word to be identified or for providing in parallel the data of said sequence according to the state of said mode selection circuit; means for providing an output signal if the comparison validates said serial sequence and said set up digital word when the receiver operates as identifier, and for providing an enabling signal when the receiver operates as a series/parallel converter.

2. A data receiver according to claim 1, wherein, in said detection means for the data of the input serial sequence when the receiver operates in said comparison mode comprises a counter controlled by an oscillator located internally of the receiver.

3. A data receiver according to claim 1, wherein for operation of the receiver as a parallel converter of a serial digital sequence shift register means driven by said pulse length detector stores said serial digital sequence; and wherein the output of said shift register is connected to said bidirectional bus.

4. A data receiver according to claims 1 or 2, comprising means for detecting the duration of said control signal during the operation in the comparison mode and for inputting or not inputting into latch means the pulse length analyzer output according to the duration of said control signal.

5. A data receiver according to claim 2, comprising means for restoration of the waveform and phase of the serial data sequence operating under the control of said internal oscillator.

6. An intercom system having a single wire for the control of a utilizer call, comprising a circuit according to claim 1 associated with each intercom unit, each intercom unit being identified by means of a different digital word set up on said bidirectional bus.

7. A system according to claim 6 characterized in that additional receivers on single wire are arranged for controlling auxiliary functions such as lights, locks and the like.

8. A system according to claims 6 or 7 characterized in that the favorable comparison output of said receiver may be connected to a loudspeaker and pulsed so that it operates as an acoustical ringer.

9. A data receiver according to claim 1, wherein said pulse length analyzer means includes pulse counter means having outputs connected to respective digital comparators, and logic gate means connecting outputs of the digital comparators to respective outputs of said pulse length analyzer means.

* * * * *